US005679046A

United States Patent [19]

Kim et al.

[11] Patent Number: 5,679,046

[45] Date of Patent: Oct. 21, 1997

[54] EXPOSING METHOD FOR FORMING FLUORESCENT LAYER OF COLOR CATHODE RAY TUBE AND APPARATUS THEREFOR

[75] Inventors: Jae-myung Kim; Hwan-chul Rho; Hong-kyu Choi, all of Suwon, Rep. of Korea

[73] Assignee: Samsung Display Devices Co., Ltd., Kyungki-do, Rep. of Korea

[21] Appl. No.: 572,711

[22] Filed: Dec. 14, 1995

[30] Foreign Application Priority Data

Mar. 17, 1995 [KR] Rep. of Korea ..... 95 5607

[51] Int. Cl.[6] ..... H01J 9/227

[52] U.S. Cl. ..... 445/52; 430/23

[58] Field of Search ..... 445/52; 430/23

[56] References Cited

U.S. PATENT DOCUMENTS 4,824,412 4/1989 Dougherty et al. ..... 445/52 X

OTHER PUBLICATIONS

JPO Abstract—JP355104049A Aug. 9, 1980.

JPO Abstract—JP35 4109755A Aug. 28, 1979.

*Primary Examiner*—Kenneth J. Ramsey

*Attorney, Agent, or Firm*—Leydig, Voit & Mayer, Ltd.

[57] ABSTRACT

A method of exposing a photosensitive layer or a fluorescent slurry layer deposited on the inner surface of a panel in which a shadow mask frame assembly is installed and apparatus therefor, are provided. A shadow mask installed inside the panel is induction-heated to a predetermined temperature using an induction-heating coil to be sufficiently expanded, and then the photosensitive layer or the fluorescent slurry layer deposited inside the panel is exposed via electron beam passing holes formed in the shadow mask. Therefore, the initial stabilization time for the CRT can be shortened.

4 Claims, 4 Drawing Sheets

EXPOSING METHOD FOR FORMING FLUORESCENT LAYER OF COLOR CATHODE RAY TUBE AND APPARATUS THEREFOR

BACKGROUND OF THE INVENTION

The present invention relates to an exposing method for forming a fluorescent layer of a color cathode ray tube (CRT) and an apparatus therefor.

Generally, as shown in FIG. 1, a color CRT 10 comprises a panel 11 on the inner surface of which a fluorescent layer 11*a* is formed, a hook spring 13 provided at the periphery of panel 11, a shadow mask frame assembly 12 having a shadow mask 12*a* formed with a plurality of holes through which an electron beam passes and a frame 12*b* supported by hook spring 13 to be separated from fluorescent layer 11*a* by a predetermined distance, and a funnel 14 sealingly connected to panel 11, having a neck portion 14*a* and a cone portion 14*b* in each of which an electron gun 15 and a deflection yoke 16 are mounted, respectively.

In color CRT 10 having the above structure, the electron beam emitted from electron gun 15 passes through the electron beam passing holes of shadow mask 12*a* having a color classification function and then is landed at a fluorescent point of fluorescent layer 11*a*, to form a picture. Thus, in order to precisely position the electron beam emitted from electron gun 15 at a fluorescent point of fluorescent layer 11*a*, shadow mask 12*a* should be supported by hook spring 13 and the distance (Q) between fluorescent layer 11*a* and shadow mask 12*a* should be controlled precisely. Also, the pattern of fluorescent layer 11*a* formed on the inner surface of panel 11 should be uniform. Especially, the distance (Q) between fluorescent layer 11*a* and shadow mask 12*a* should be precisely controlled, as the CRT is driven.

However, shadow mask 12*a* cannot completely pass the electron beams emitted from electron gun 15 therethrough. That is, since the electron beams partially pass through the beam passing holes of shadow mask 12*a*, shadow mask 12*a* is heated by thermal electrons which do not pass through the holes. Consequently, shadow mask 12*a* is expanded by the heat and a central portion of shadow mask 12*a* becomes convex, resulting in a phenomenon called "doming," thereby varying the distance (Q). The doming of shadow mask 12*a* causes the location of the holes formed in shadow mask 12*a* to shift. As a result, the electron beam emitted from electron gun 14 cannot precisely land at the fluorescent point.

To solve the above problem, according to the prior art, hook spring 13 for supporting shadow mask frame assembly 12 inside panel 11 is made of a bimetal, so that shadow mask frame assembly 12 is shifted to maintain the distance (Q) as hook spring 13 is heated. However, in order to maintain the distance (Q) by shifting shadow mask frame assembly 12, so as to compensate for the doming phenomenon caused by the thermal expansion of shadow mask 12*a*, shadow mask 12*a* should be primarily heated by the thermal electrons which do not pass the beam passing holes of shadow mask 12*a*, frame 12*b* should be heated, and then hook spring 13 should be heated via the heated frame 12*b*. As a result, the initial stabilization time for the CRT is lengthened.

To solve the above problem, according to a prior art technique, an auxiliary exposing lens is employed for exposing a photosensitive layer and fluorescent slurry layer so as to compensate for the expansion of the shadow mask when the CRT normally operates. However, the auxiliary exposing lens is difficult to design since its curvature should be different at each portion of a screen of the CRT.

Also, as another method of compensating for the doming phenomenon of the shadow mask, the shadow mask may be made of Invar material having a relatively low thermal expansion rate. Invar material, however, is expensive and exhibits rather poor characteristics in terms of processing, welding, and a darkening process.

SUMMARY OF THE INVENTION

To solve the above problem, it is an object of the present invention to provide an exposing method of forming a fluorescent layer of a color CRT in which an initial stabilization time of the CRT can be shortened and an inferiority in color purity can be prevented, and an apparatus therefor.

To achieve the object of the present invention, there is provided an exposing method of forming a fluorescent layer of a color CRT, the method comprising the steps of: installing a shadow mask inside a panel on the inner surface of which a photosensitive layer or a fluorescent slurry layer to be exposed is deposited, so that the shadow mask is separated from the photosensitive layer or the fluorescent slurry layer by a predetermined distance; heating the shadow mask installed inside the panel to a predetermined temperature, so as to expand the shadow mask; and exposing the photosensitive layer or the fluorescent slurry layer deposited on the inner surface of the panel by irradiating light onto the shadow mask via electron beam passing holes formed in the shadow mask with the shadow mask being expanded by the heating step.

To achieve the object of the present invention, there is provided an exposing apparatus for forming a fluorescent layer of a color CRT comprising: a frame for supporting the inner brim portion of a panel on the inner surface of which a photosensitive layer or a fluorescent slurry layer is deposited and inside which a shadow mask is installed; a light source installed opposite to the inside of the panel; an exposing lens placed between the light source and the panel; and heating means for heating the shadow mask installed inside the panel to a predetermined temperature.

In the above exposing apparatus, the heating means is composed of an induction heating coil provided on the outer surface of the panel.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

An exposing method for forming a fluorescent layer of a color CRT according to the present invention is for exposing a photosensitive layer and a fluorescent slurry layer deposited on the inner surface of a panel in which a shadow mask frame assembly is installed.

Figure 1:
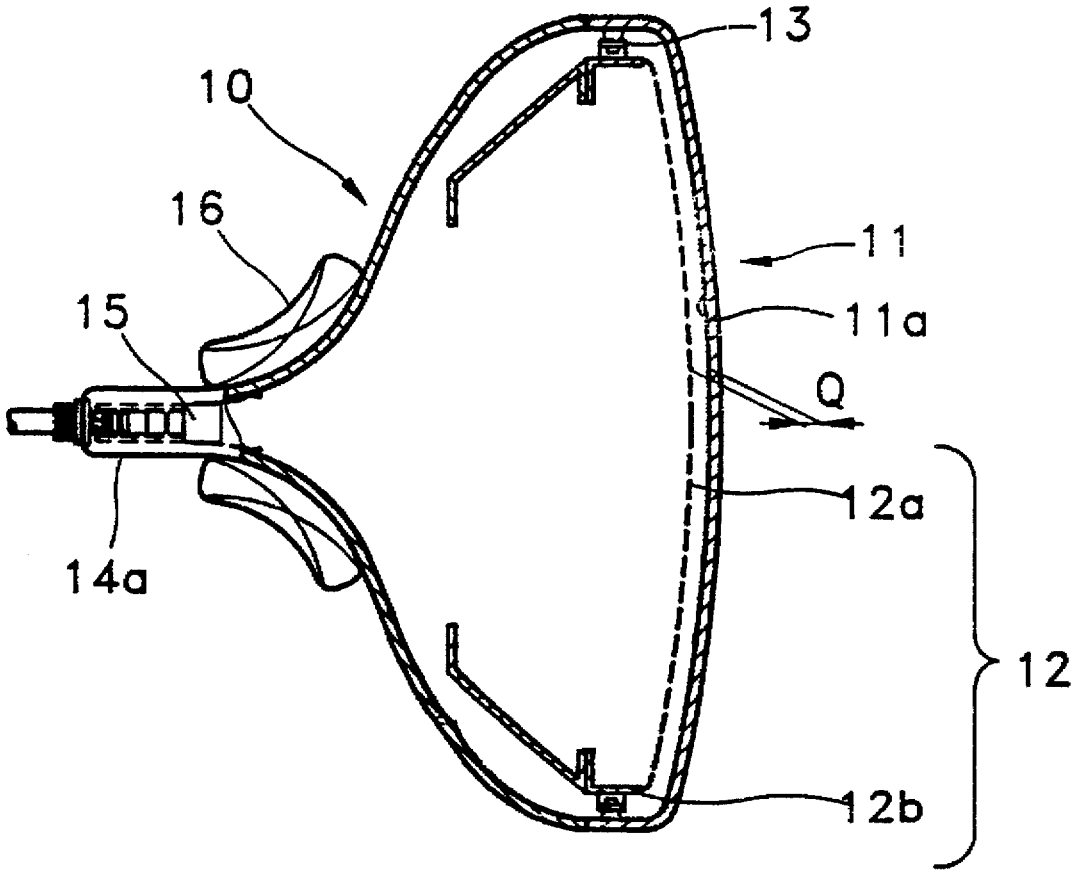
FIG.1(PRIOR ART)
FIG. 1 is a sectional view of a conventional color CRT.
Figure 2A:
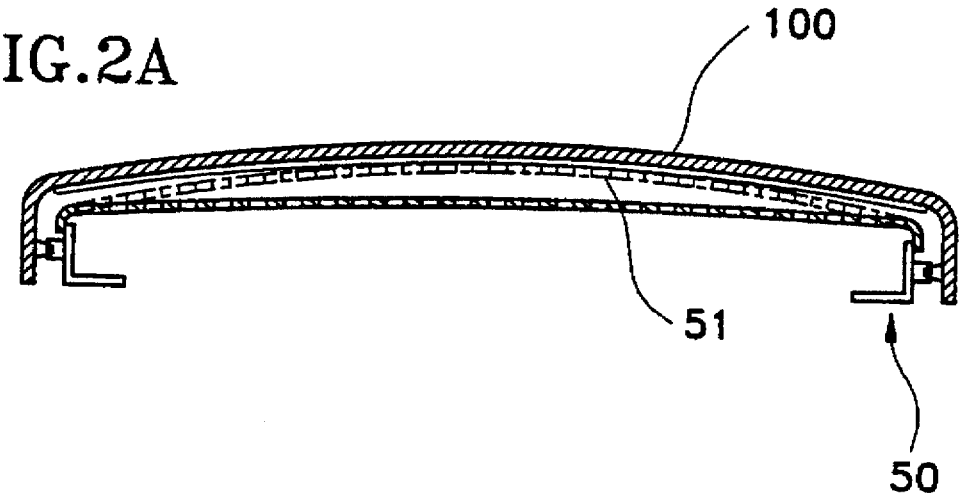
FIGS. 2A–2C are sectional views for sequentially illustrating a method of forming a fluorescent layer inside a panel according to the present invention.
Figure 2B:
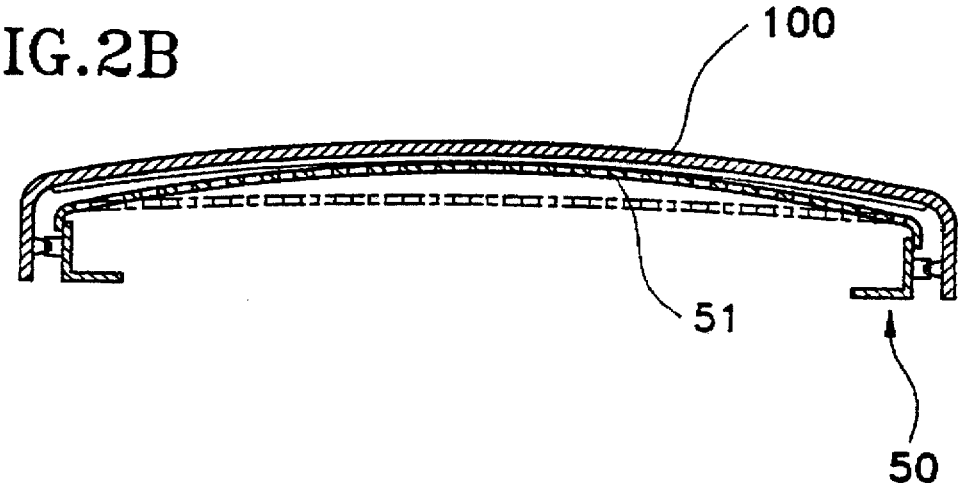
Figure 2C:
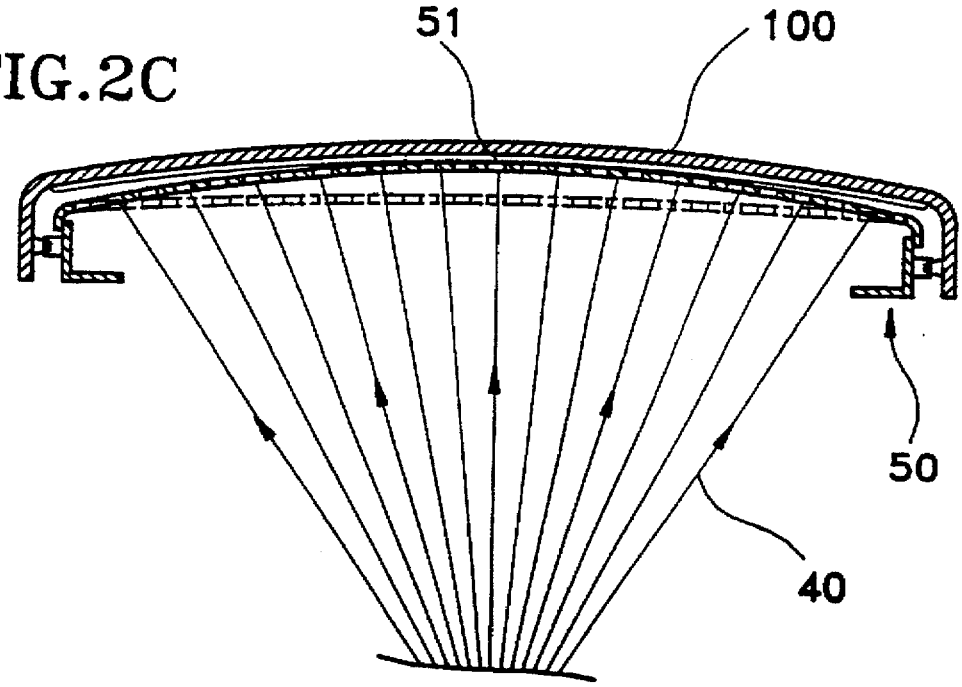

This method is for exposing the photosensitive layer so as to form a non-luminous light-absorption layer, i.e., a black matrix layer, of a predetermined pattern, and then for exposing the fluorescent slurry layer so as to form red, green and blue fluorescent layers between the black matrix, when forming the fluorescent layer on the panel. As shown in FIGS. 2A to 2C, this method comprises the steps of installing a shadow mask 51 of a shadow mask frame assembly 50 inside a panel 100 while being separated from the photosensitive layer and the fluorescent slurry layer by a predetermined distance (see FIG. 2A), heating shadow mask frame assembly 50 installed inside panel 100 at a predetermined temperature (see FIG. 2B), and irradiating a light beam emitted from an exposing light source to the photosensitive layer and the fluorescent slurry layer deposited on panel 100 via a multitude of electron beam passing holes formed in shadow mask 51, through which electron beams pass, with shadow mask 51 being expanded through the above heating process (see FIG. 2C). It is preferable that shadow mask 51 installed inside panel 100 is heated using an induction heating method by means of a high-frequency induction heating coil installed on the outer surface of panel 110 or a hot air method.

In the above exposing method, since the photosensitive layer and the fluorescent slurry layer are exposed with shadow mask 51 being expanded through the heating process, the trace of the light beam emitted from the light source is the same as that of the electron beam which is emitted from an electron un of the color CRT and passes through the beam passing holes of the shadow mask the location of which is shifted by the heat-expansion of the shadow mask as the CRT is driven. Thus, the probability that the electron beam is mislanded on the fluorescent point of the fluorescent layer due to the doming phenomenon is substantially reduced. Consequently, the prevention of the mislanding prevents the purity characteristic from being lowered, which may occur due to the doming phenomenon of the CRT.

Figure 3:
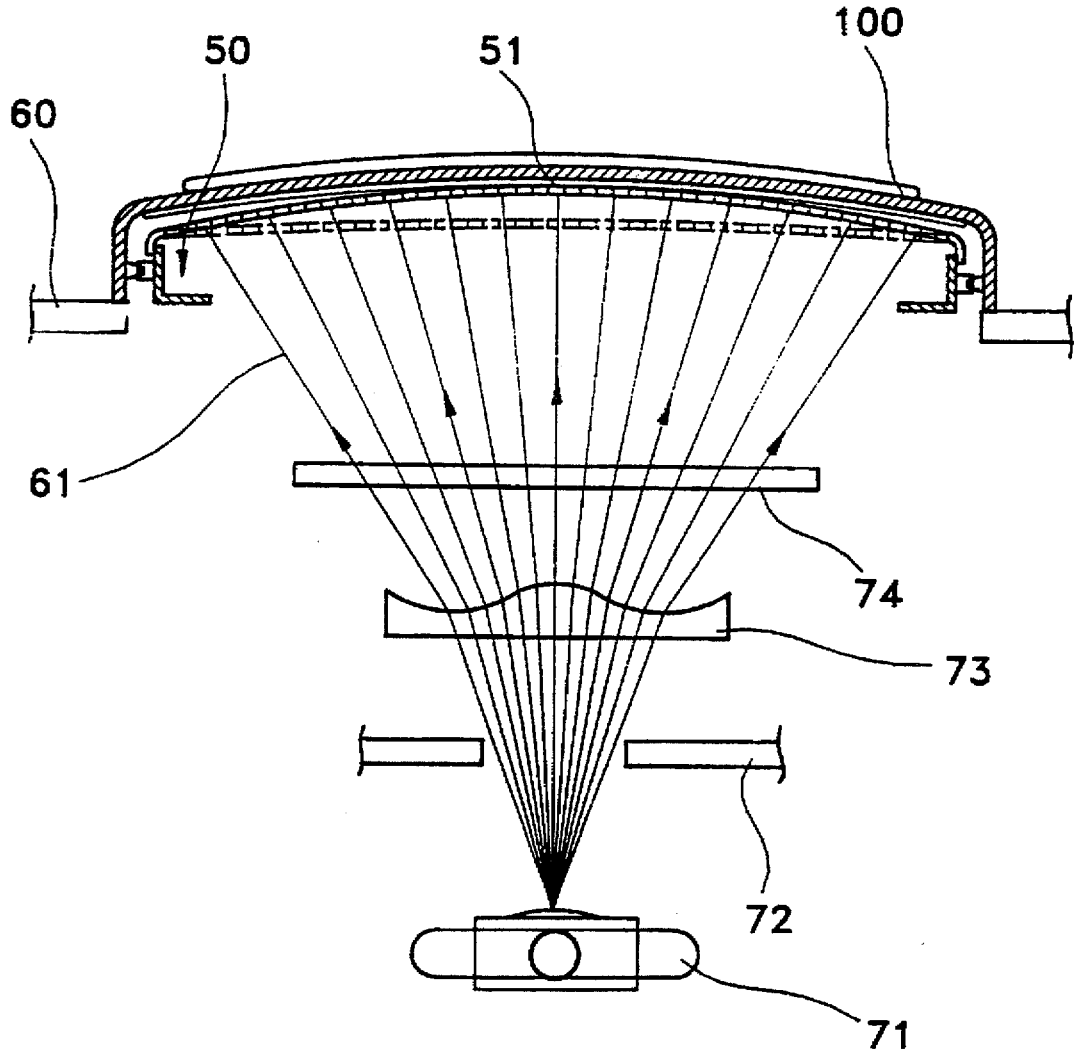
FIG. 3 is a diagram of schematically showing an exposing apparatus for forming a fluorescent layer inside a panel according to the present invention.

FIG. 3 shows an exposing apparatus for forming a fluorescent layer of a color CRT according to a preferred embodiment of the present invention.

Figure 4:
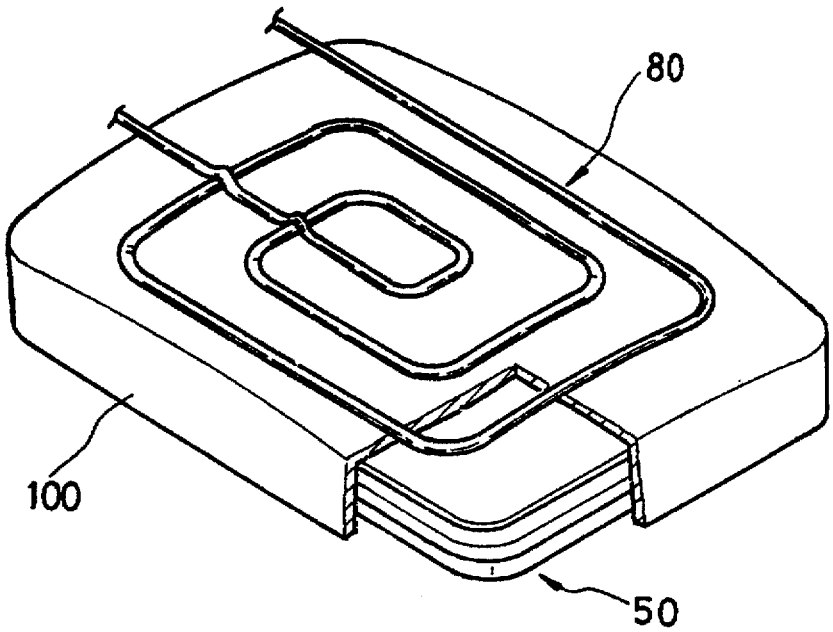
FIG. 4 is a perspective view showing a state where an induction heating coil for heating a shadow mask is provided on the panel according to a preferred embodiment of the present invention.
Figure 5:
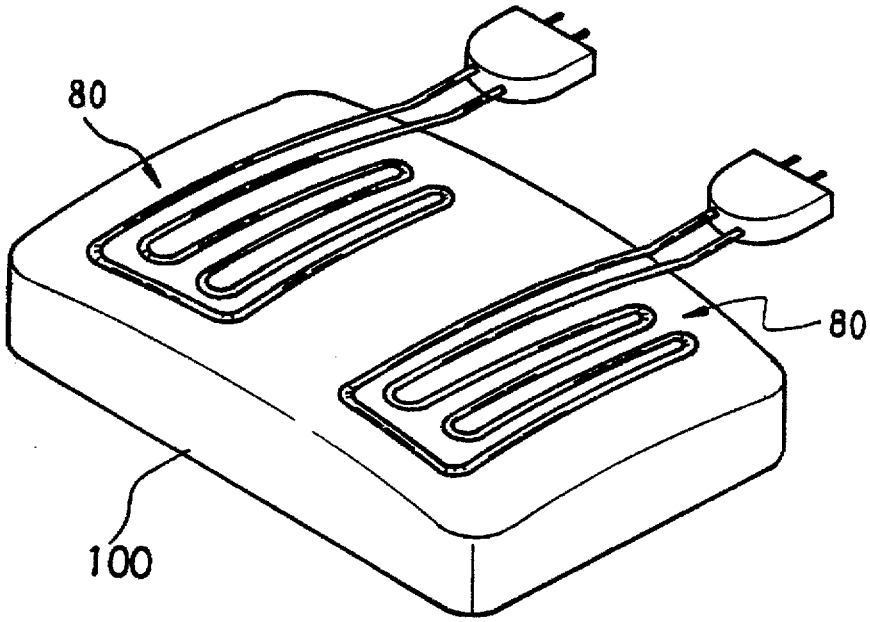
FIG. 5 is a perspective view showing a state where an induction heating coil is provided on the panel according to another preferred embodiment of the present invention.

A panel 100 in which a shadow mask frame assembly 50 is installed and the photosensitive layer or the fluorescent slurry layer is formed, is located inside the exposing apparatus. The exposing apparatus comprises a frame 60 having an opening 61 corresponding to the inside of panel 100, a light source 71 for emitting a light beam to the inner side of panel 100, being disposed opposite to the inner side of panel 100, a shutter 71, an exposing lens 73 and a filter 74 which are sequentially arranged from light source 71 between light source 71 and the inner side of panel 100. Also, as shown in FIG. 4, a high-frequency induction heating coil 80 for induction-heating shadow mask 51 of shadow mask frame assembly 50 installed inside panel 100 is placed on the outer surface of panel 100. As shown in FIG. 5, it is preferable that induction heating coil 80 is installed while being separated at both sides of panel 100 where the doming phenomenon of shadow mask 51 is concentrated.

The operation of the exposing apparatus having the above structure will be described below.

In order to expose the photosensitive layer or fluorescent slurry layer formed on the inner surface of panel 100, a predetermined electric potential is applied to high-frequency induction heating coil 80 for induction-heating shadow mask 51, to thereby heat shadow mask frame assembly 50 to a predetermined temperature, that is, 80°–90° C., at which the CRT operates. When heating shadow mask 51, shadow mask 51 may be heated to the temperature at which the doming phenomenon of shadow 51 occurs.

When shadow mask 51 of shadow mask frame assembly 50 is completely heated as described above, the light beam emitted from light source 71 is irradiated to the inner side of panel 100 via exposing lens 73. Then, the light beam emitted from light source 71 passes through the beam passing holes of shadow mask 51 which is expanded by the heat and undergoes the doming phenomenon, and arrives at the inner side of panel 109, to thereby expose the photosensitive layer or the fluorescent slurry layer.

Exposing the photosensitive layer or the fluorescent slurry layer after heat-expanding shadow mask 51 through the heating process means that the exposing is conducted under the domed state. Thus, according to the CRT adopting the fluorescent layer formed by the above exposure, the mislanding of the electron beam on the fluorescent layer due to the doming phenomenon can be prevented. Thus, the initial picture stabilization time of the CRT can be shortened. Also, the electron beam emitted from the electron gun can be exactly landed onto the fluorescent point at the driving state of the CRT, so that the purity characteristic of the picture can be improved.

As described above, the exposing method of forming the fluorescent layer of the color CRT and the apparatus therefor are not limited to the above-described preferred embodiments, and further modifications and improvements will occur within the spirit and scope of this invention.

What is claimed is:

1. An exposing method of forming a fluorescent layer of a color CRT, comprising the steps of:

mating a shadow mask to an inside surface of a panel, the inside surface of the panel including a photosensitive layer or a fluorescent slurry layer wherein mating includes separating the shadow mask from the photosensitive layer or the fluorescent slurry layer by a predetermined distance;

heating the shadow mask installed on the inside surface of the panel to a predetermined temperature to expand the shadow mask; and exposing the photosensitive layer or the fluorescent slurry layer disposed on the inner surface of the panel by irradiating light onto the shadow mask through electron beam passing holes formed in the shadow mask after heating the shadow mask.

2. An exposing apparatus for forming a fluorescent layer of a color CRT comprising:

a frame for supporting an inner brim portion of a panel, the panel including an inner surface having a photosensitive layer or a fluorescent slurry layer and including a shadow mask mated to the inner surface such that a predetermined distance is established between the shadow mask and the photosensitive layer or fluorescent slurry layer;

a light source disposed opposite to the inside surface of the panel;

an exposing lens disposed between said light source and the panel; and heating means for heating the shadow mask mated to the inner surface of the panel to a predetermined temperature.

3. An exposing apparatus as claimed in claim 2, wherein said heating means includes an induction-heating coil disposed on an outer surface of the panel.

4. An exposing apparatus as claimed in claim 3, wherein said induction-heating coil is disposed at first and second sides of the panel.

* * * * *